US005406937A

United States Patent [19]

Uglietto et al.

[11] Patent Number: 5,406,937

[45] Date of Patent: Apr. 18, 1995

[54] FINNED RADIATOR AND SOLAR HEATING SYSTEM

[76] Inventors: Salvatore R. Uglietto; Peter J. Uglietto, both of 42 Mayflower Rd., Winchester, Mass. 01890

[21] Appl. No.: 46,304

[22] Filed: Apr. 15, 1993

[51] Int. Cl.[6] ..... F24J 3/02

[52] U.S. Cl. ..... 126/659; 126/604; 126/640; 165/129; 165/182

[58] Field of Search ..... 126/659, 658, 640, 583, 126/609; 165/55, 129, 182

[56] References Cited

U.S. PATENT DOCUMENTS

| | | | |
|---|---|---|---|
| 1,776,080 | 9/1930 | Murray . | |
| 1,882,719 | 10/1932 | Armstrong . | |
| 1,914,197 | 6/1933 | Davis . | |
| 2,899,786 | 8/1956 | Dubin | 252/262.16 |
| 3,091,281 | 5/1963 | Weinstein | 165/55 |
| 3,367,132 | 2/1968 | Elliot | 62/285 |
| 3,470,947 | 10/1969 | Andreoli | 165/55 |
| 3,867,981 | 2/1975 | Munroe | 165/55 |
| 4,011,856 | 3/1977 | Gallagher | 126/659 |
| 4,147,157 | 4/1979 | Zakhariya | 126/586 |
| 4,195,687 | 4/1980 | Taziker | 165/129 |
| 4,428,418 | 1/1984 | Beasley | 165/76 |
| 4,928,756 | 8/1990 | Shull | 165/182 |

FOREIGN PATENT DOCUMENTS

| | | | |
|---|---|---|---|
| 62363 | 4/1982 | Japan | 126/609 |

*Primary Examiner*—Larry Jones

[57] ABSTRACT

A fin type radiating system is presented having an exposed rear flange for ease in installing, while improving efficiency. The resulting system is environmentally sound and durable.

21 Claims, 3 Drawing Sheets

FINNED RADIATOR AND SOLAR HEATING SYSTEM

FIELD OF THE INVENTION

This invention relates to heat radiating fins.

BACKGROUND OF THE INVENTION

Baseboard radiators were developed to take advantage of areas where space of considerable length was available. In general, the structure comprised a series of vertical plates (fins) which radiated heat arranged on a pipe which had a circulating fluid such as steam or hot water. Additionally, a front cover plate provided a hood to deflect the heat and a protective wall plate.

U.S. Pat. No. 1,776,080 discloses an early baseboard heater. The wall plate serves also as a mounting support.

U.S. Pat. No. 1,914,197 discloses a more sophisticated method of directing the air, by forming a curved channel. Production of this design is costly and bulky.

U.S. Pat. No. 3,091,289, incorporated herein by reference, presents alternative shaping to thin fin assemblies, presenting flat fins having trapezoidal and parallelogram shapes.

U.S. Pat. No. 3,367,132, shows a valance system, demonstrating that finded heating and cooling systems can be located in positions other than the floor.

U.S. Pat. No. 4,195,687, incorporated herein by reference, discloses a system which provides a bent fin that forms a wall plate and a front plate. A method for attaching the system to the wall is not disclosed.

SUMMARY OF THE INVENTION

A fin system, suitable for use with a solar collection system or with conventional systems is presented. The fin provides an easily accessible, flexible system of attachment to a wall or other support by means of a rear flange. Access to the flange is provided by a taper of the fin. The taper also improves the circulation of the heated air. In one version, a second flange substantially parallel to the rear flange is provided to add strength and eliminate the necessity of a front plate, element hanger, backplate, and/or a damper.

DETAILED DESCRIPTION OF THE EMBODIMENTS

Figure 1:
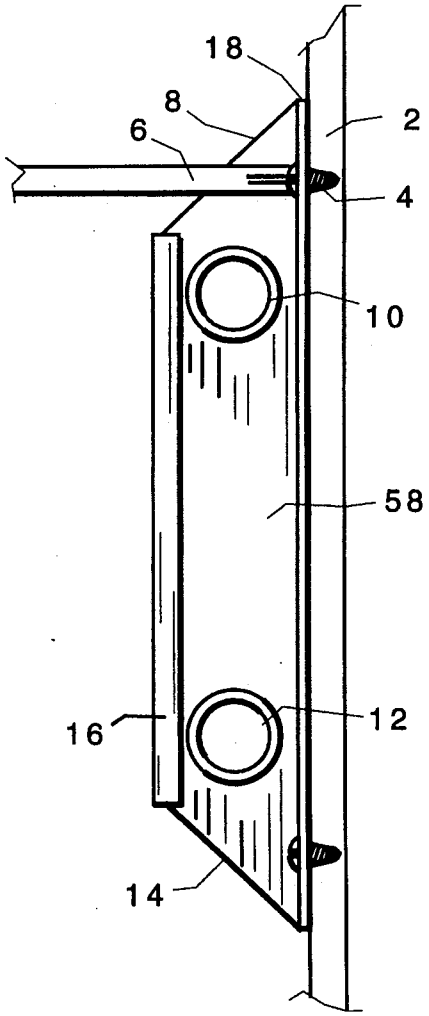
FIG. 1 is a side view of a fin during attachment.
Figure 2:
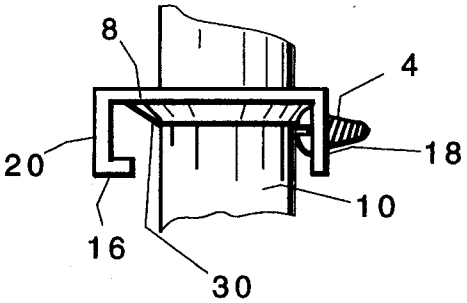
FIG. 2 is a top view of a modification of the fin of FIG. 1.
Figure 3:
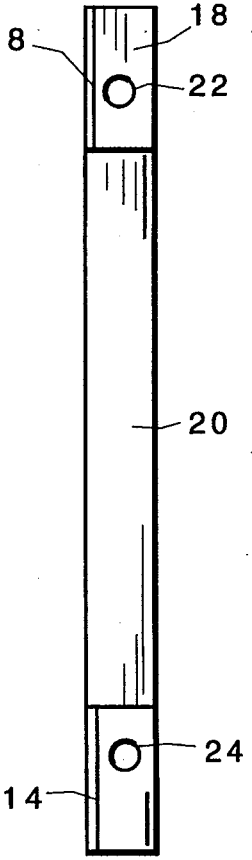
FIG. 3 is a front view of the fin of FIG. 1.

FIGS. 1 through 3 show a radiating fin having a modified trapezoidal shape. Radiating for purposes of this application shall mean radiating of coolness as well as warmth. The trapezoidal side web (58) has a back flange (18) which is placed against a wall (2). If desired, rubber grommets can be used to space the flange within 3 mm of the wall. The oblique upper (8) and lower (14) edges of the side web (58) provide access to a fastening device (4) such as a screw, nail, bolt or staple by a tool (6) such as a screw driver. A front flange (20) is shorter in length than the back flange (18), and has an optional front side flange (16) to provide smoother abutment between fins and to increase structural strength. The side web (58) has apertures (70) and (72) for a top (10) and bottom (12) pipes which carry a heated or cooled fluid. While the fins may be slipped on the pipes and depend on friction for contact, a collar (30) may be provided for better fit and contact. Alternatively, conduction between the pipe and the fin could be improved by attachment with a heat conductive cement.

When a number of the fins are placed side by side on a pipe, a back wall is formed by a plurality of back flanges (18) and a front wall is formed by a plurality of front flanges (20). Since each fin is provided with top and bottom apertures (22) and (24), attachment can be properly made at a variety of points, minimizing the problem of having structural attachment points such as studs match available holes of a baseboard or valance unit.

The shape of the fin also provides an efficient chimney effect, drawing cold air at the base (for heating) an spreading radiating it at the top. To further direct air at the emitting end of the fin, The rear fin could be extended at the top and the extension bent forward. For safety, it is suggested that the extension have side and front flanges. A blank for forming such a fin is shown in FIG. 6.

Figure 4:
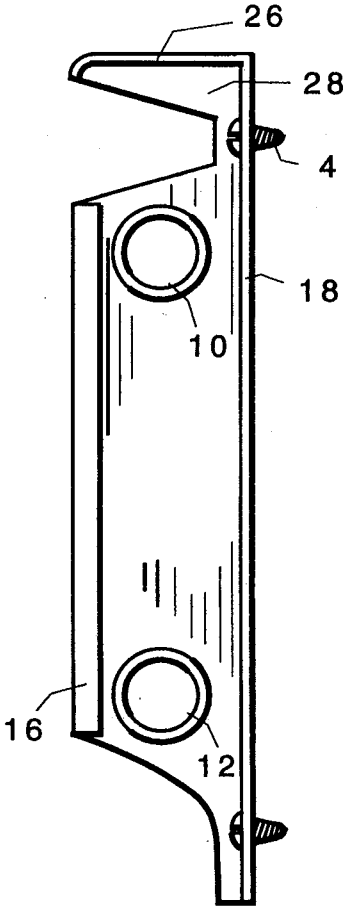
FIG. 4 is a side view of a fin having a beak shaped top and bird tail like bottom.

FIG. 4 shows a fin having a beak shaped upper side web (28) and a top flange (26). This design increases heating efficiency while maintaining the access to a fastener (4).

Figure 6:
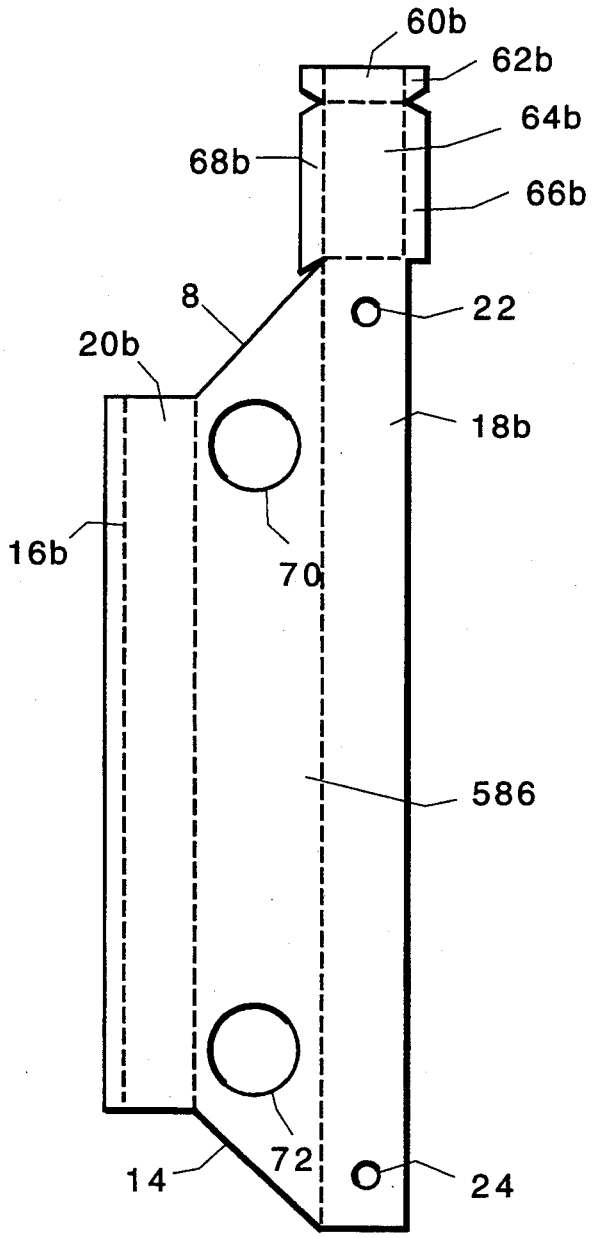
FIG. 6 shows a blank suitable for forming a fin.

FIG. 6 shows a blank for a fin which can be cut from a sheet of metal. By valley folding along the dashed lines, section (**60*b*) becomes a top front flange; section (64*b*) becomes a deflecting top; sections (62*b*), (66*b*) and (68*b*) become top side flanges; section (18*b*) becomes back flange (18); section (58*b*) becomes side web (58); section (20*b*) becomes front flange (20); and section (16*b*) becomes front side flange (16**).

Figure 5:
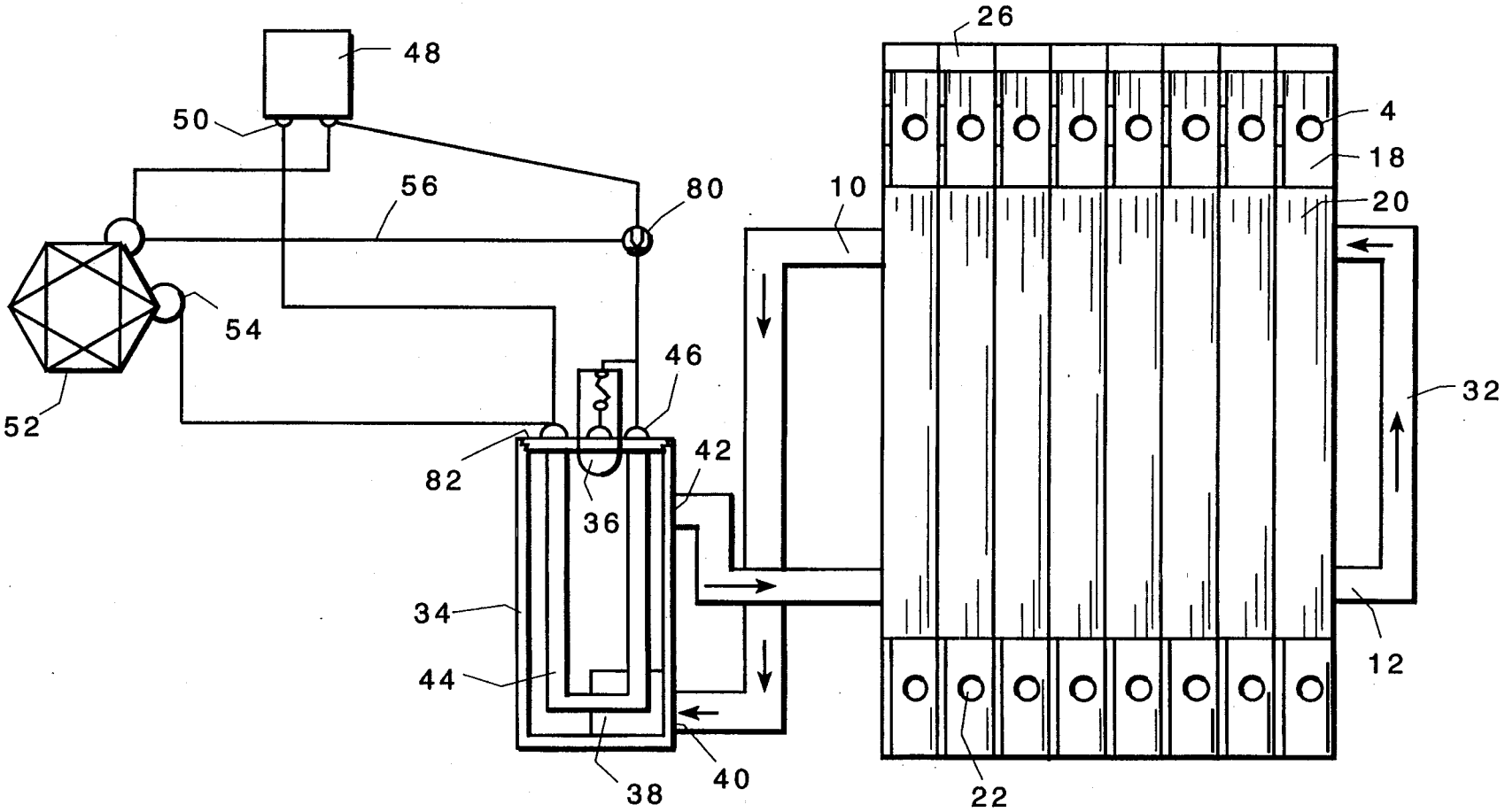
FIG. 5 is a schematic view of a solar heating system using the fin of FIG. 4.

FIG. 5 shows a solar heating system using fins such as shown in FIG. 4. Lower pipe (12) and upper pipe (10) are connected at one end by pipe (32). Several fins are fitted over the pipes (10) and (12). The number of fins to form a length within the body of the radiator is dependent on the heat loss in a particular room or area. The fins can be formed by extrusion, or by stamping and then folding or roller forming. A vessel (34) having lower inlet (40) and upper outflow (42) pipes is connected to remaining ends of pipes (10) and (12) respectively. The vessel (34) has a heating element (44), limit control (36), circulating pump (38), a screw on/off top (82) for maintainence and filling with a heat transfer fluid, and electrodes (46). Terminals (54) of a photovoltaic solar collector (52) and terminals (50) of a storage battery (48) are connected by wires (56) to each other and the vessel electrodes (46). The storage battery (48) supplies energy during darkness, the collector (52) during day. Excess energy collected during the day is stored for later use by the battery (48). As heated fluid circulates through the pipes, heat is disbursed by two methods; radiation off front and top flanges, and convection through the chimney effect. Ideally, the vessel (34) is very compact so that it may reside next to the fins and behind a cover similar to the fins for continuity.

When a thermostat (80) indicates heat is called for, the pump (38) and heating element (44) are energized. The heating element (44), heats the fluid to a desired temperature, while the pump (38) circulates the fluid from the vessel (34) through the lower heating line (12), around through the top heating line (10) and back to the vessel (34) until the thermostat (80) is satisfied.

The limit control (36) is set to a predetermined temperature to prevent overheating of the fluid within the radiator. If, by chance, the temperature of the fluid reaches its limit, the limit control contacts open and the heating element (44) is automatically shut off. The pump (38) continues running until the thermostat and limit control are satisfied.

If desired, inlet (40) and outlet (42) pipes can be Teed into a backup system with the aid of check valves.

Pipes and fins are of rigid heat conductive material such as metal. Typically pipes are made from copper and fins from sheet or extruded aluminium or steel.

The fins disclosed herein may be attached to a unit prior to shipping, or could be attached at an installation site with minimal equipment in order to provide custom lengths.

While the fins disclosed have cross sections of right angled C shapes due to ease in forming, this should not be considered limiting. Other shapes such as Z, or a cross section similar to that disclosed in U.S. Pat. No. 4,195,687 are possible.

What is claimed is:

1. A radiating fin comprising:

a side web having front, back, vertical limiting edges, and being crossed by a horizontal plane to define a vertical center, wherein at least one of said vertical limiting edges meets said front edge at a point closer to the vertical center than a point at which said limiting edge meets said back edge;

a back flange having vertical limiting and side edges said flange extending from said side web back edge and being provided with at least one location for a fastener at a point further from said horizontal plane than the point joining said side web vertical limiting and side edges; and means in said side web for receiving and contacting at least one conductive member.

2. The fin of claim 1 further comprising:

a front flange extending from said side web front edge.

3. The fin of claim 2 further comprising:

a front side flange.

4. The fin of claim 2 wherein said location is an aperture.

5. The fin of claim 1 wherein said side web has a trapezoidal shape.

6. The fin of claim 2 wherein said means further comprises:

at least two round apertures.

7. The fin of claim 6 wherein said means further comprises:

a collar.

8. The fin of claim 2 further comprising:

a top flange.

9. The fin of claim 8 further comprising:

a top front flange.

10. The fin of claim 8 further comprising:

top side flanges.

11. The fin of claim 10 further comprising:

top side and top front side flanges.

12. The fin of claim 2 wherein said fin has a cross sectional shape chosen from the group consisting of Z and C shapes.

13. The fin of claim 1 wherein said fin is made from a metal chosen from the group consisting of steel, copper, and aluminium.

14. The fin of claim 3 wherein:

said location is an aperture;

said side web has a trapezoidal shape;

said means comprises at least two apertures; and said fin is formed from sheet metal.

15. The fin of claim 14 further comprising:

a top flange;

a top front flange;

top side flanges; and top front side flanges.

16. The fin of claim 14 wherein said fin is formed from a single piece of material.

17. The fin of claim 15 wherein said fin is formed from a single piece of material.

18. A solar heating system comprising:

a plurality of fins, each fin comprising:

a side web having front, back, vertical limiting edges, and being crossed by a horizontal plane to define a vertical center, wherein at least one of said vertical limiting edges meets said front edge at a point closer to the vertical center than a point at which said limiting edge meets said back edge;

a back flange having vertical limiting and side edges said flange extending from said side web back edge and being provided with at least one location for a fastener at a point further from said horizontal plane than the point joining said side web vertical limiting and side edges;

means in said side web for receiving and contacting at least one fluid carrying pipe; and a front flange extending from said side web front edge;

a pipe having a first and second end, said pipe contacting said side web at said means;

a vessel having an intake and outflow, said intake and outflow being connected to said first and second pipe ends;

a circulating pump for circulating said fluid in said system;

a heating element located within said vessel; and a solar energy collection means, said collection means being connected to said heating element.

19. The system of claim 18 further comprising:

a limit control.

20. The system of claim 19 wherein said energy collection means further comprises:

a photovoltaic system being in electrical contact with said heating element.

21. The fin of claim 1 wherein said side web has a bird shape said shape having a tail shape at the junction of the lower and back limiting edges, a somewhat elongated central body portion, a head shape at the junction of the upper and back limiting edges, and an indentation defining a lower edge of said head shape and defining an upper edge of said central body portion.

* * * * *